US008590948B2

(12) United States Patent
Shen

(10) Patent No.: US 8,590,948 B2
(45) Date of Patent: Nov. 26, 2013

(54) OUTER OPERATIONAL DEVICE FOR PANIC EXIT DOOR LOCK

(75) Inventor: Chun-Meng Shen, Tainan (TW)

(73) Assignee: I-Tek Metal Mfg. Co., Ltd, Tainan (TW)

( * ) Notice: Subject to any disclaimer, the term of this patent is extended or adjusted under 35 U.S.C. 154(b) by 521 days.

(21) Appl. No.: 13/004,969

(22) Filed: Jan. 12, 2011

(65) Prior Publication Data

US 2012/0175892 A1 Jul. 12, 2012

(51) Int. Cl.
*E05B 3/00* (2006.01)
*E05B 47/00* (2006.01)

(52) U.S. Cl.
USPC ..... 292/336.3; 292/92; 292/144; 292/165; 292/DIG. 65; 70/92; 70/277; 70/278.7; 70/279.1; 70/283; 70/465

(58) Field of Classification Search
USPC ..... 70/277, 278.7, 279.1, 283, 92, 465, 70/106, 20, 467, 483–485; 292/92–94, 292/57–61, 63–68, 137, 156, 158, 159, 161, 292/163, 165, 169, 169.13, 169.14, 169.15, 292/169.17, 169.19, 173, 139, 140, 143, 292/192, 336.5, 336.3, 144, 138, DIG. 52, 292/DIG. 65
See application file for complete search history.

(56) References Cited

U.S. PATENT DOCUMENTS 3,999,411 A * 12/1976 Kambic ..... 70/144
4,145,900 A * 3/1979 Ohno ..... 70/92
4,979,383 A * 12/1990 Tully ..... 70/107
4,982,986 A * 1/1991 Gressett et al. ..... 292/336.3
4,995,248 A * 2/1991 Liu ..... 70/107
5,715,715 A * 2/1998 Nunez ..... 70/283
5,987,945 A * 11/1999 Ruano Aramburu ..... 70/277
6,145,353 A * 11/2000 Doucet ..... 70/277
6,354,121 B1 * 3/2002 Frolov ..... 70/277
6,487,884 B1 * 12/2002 Constantinou ..... 70/277
6,640,594 B1 * 11/2003 Yao ..... 70/277
6,725,693 B2 * 4/2004 Yu et al. ..... 70/107
6,758,070 B2 * 7/2004 Yu et al. ..... 70/107
6,851,291 B2 * 2/2005 Nunez ..... 70/283
7,007,526 B2 * 3/2006 Frolov et al. ..... 70/277
7,168,276 B2 * 1/2007 Errani et al. ..... 70/278.7
7,181,940 B2 * 2/2007 Lin ..... 70/472
7,188,495 B2 * 3/2007 Errani et al. ..... 70/278.7
7,757,524 B2 * 7/2010 Frolov et al. ..... 70/277
7,818,984 B2 * 10/2010 Hwang ..... 70/107
7,870,770 B2 * 1/2011 Blanch ..... 70/279.1
7,963,574 B2 * 6/2011 Geringer et al. ..... 292/144
8,001,818 B2 * 8/2011 Imedio Ocana et al. ..... 70/472
2005/0092046 A1 * 5/2005 Errani et al. ..... 70/283
2006/0112747 A1 * 6/2006 Moon et al. ..... 70/283

* cited by examiner

*Primary Examiner* — Carlos Lugo
*Assistant Examiner* — Alyson M Merlino
(74) *Attorney, Agent, or Firm* — Alan Kamrath; Kamrath IP Lawfirm, P.A.

(57) ABSTRACT

An outer operational device includes a cover mounted to an outer side of a door. The outer operational device includes a handle and an actuating member operatively connected between the handle and a latch. A sliding block is movable between an alignment position and an alignment position under control of a driving device through electrification. When the sliding block is in the engagement position, a locking block locks the actuating member to prevent rotation of the handle, and the outer operational device is in a locked state avoiding retraction of the latch. When the sliding block is in the disengagement position, the sliding block allows rotation of the actuating member and the handle, and the outer operational device is in an unlocked state allowing retraction of the latch.

8 Claims, 13 Drawing Sheets

OUTER OPERATIONAL DEVICE FOR PANIC EXIT DOOR LOCK

BACKGROUND OF THE INVENTION

The present invention relates to an outer operational device for a panic exit door lock and, more particularly, to an outer operational device that includes a handle for retracting a latch of a lock for a panic exit door lock and that can be locked or unlocked through electric control.

A wide variety of locks with differing structures and differing functions has been proposed for different places, providing versatile options for the users. A type of panic exit door lock includes a lock mounted in a door and inner and outer operational devices mounted to inner and outer sides of the door. Each of the inner and outer operational devices includes a driving rod extending through the door into a case of the lock and operatively connected to the latch. The inner operational device includes an operative member that can be pressed to retract the latch through transmission by the driving rod. The outer operational device includes a handle that can be rotated to retract the latch. The door can be opened when the latch is retracted. Instead of using a lockable mechanism in the outer operational device, a cylinder is used for locking or unlocking purposes. The latch can not be retracted when in a locking state, because the handle of the outer operational device can not be rotated. The handle includes a stem extending in a radial direction perpendicular to the rotating direction of the handle. When in the locking state, the interior elements of the lock could be damaged by the torque acting on the handle through transmission by the driving rod of the outer operational device. In this case, the inner and outer operational devices must be detached from the door for replacement and/or maintenance, which is troublesome. Furthermore, a metal key is required for operating the cylinder.

BRIEF SUMMARY OF THE INVENTION

In view of the disadvantages of conventional locks, the present invention provides an outer operational device for a panic exit door including a cover adapted to be mounted to an outer side of a door. The cover includes a sidewall and an annular wall together defining a space. A protrusion is formed on an inner face of the sidewall. The protrusion includes a first track extending along a first axis and a second track extending along a second axis perpendicular to the first axis and in communication with the first axis. A handle is mounted to an outer side of the cover. The handle is rotatable about a third axis perpendicular to the first and second axes between first and second positions. A shank is fixed to the handle to rotate therewith. The shank includes a non-circular engaging portion extending into the space of the cover. An actuating member is mounted in the space and includes an end and a non-circular connecting hole engaged with the engaging portion to rotate therewith. The actuating member further includes an engaging block aligned with the first track. A driving member is rotatably received in the space of the cover. The driving member includes a wing and a driving rod. The driving rod extends along the third axis. The driving rod is adapted to be operatively connected to a latch of a lock mounted in the door, so that the latch is moved from a latching position to an unlatching position when the handle is rotated from the first position to the second position. A link includes an upper end and a lower end. The upper end of the link is pivotably connected to the wing of the driving member. The lower end of the link is pivotably connected to the end of the actuating member. A locking block is slideably received in the first track along the first axis between an engagement position and a disengagement position. The locking block includes top and bottom sides spaced along the first axis. An engaging groove extends from the top side towards but spaced from the bottom side. The locking block further includes a follower portion. The engaging block of the actuating member is engaged in the engaging groove when the locking block is in the engagement position, preventing rotation of the actuating member about the third axis. The engaging block of the actuating member is disengaged from the engaging groove when the locking block is in the disengagement position, allowing rotation of the actuating member about the third axis. A sliding block is slideably received in the second track along the second axis between an alignment position and a misalignment position. The sliding block includes a depression extending along the first axis. The sliding block further includes first and second engagement grooves spaced along the second axis. When the sliding block is in the alignment position, the follower portion of the locking block is engaged in the depression of the sliding block, and the locking block is in the disengagement position. A face of the depression of the sliding block pushes the follower portion of the locking block to move the locking block to the engagement position when the sliding block is moved from the alignment position to the misalignment position. A driving device is mounted in the space of the cover and spaced from the second track along the first axis. The driving device includes an actuating rod. The driving device is electrically connected to a power supply. An actuating plate is fixed to the actuating rod to move therewith. The actuating plate includes an insertion section.

When the outer operational device is in a first mode, the insertion section is engaged in the first engagement groove of the sliding block. When the driving device is not electrified by the power supply, the sliding block is in the alignment position, and the locking block is in the disengagement position. The handle is rotatable from the first position to the second position, so that the outer operational device is in an unlocked state. The handle is rotatable to rotate the actuating member. The driving member is rotated through the link, moving the latch from the latching position to the unlatching position.

When the outer operational device is in the first mode and when the driving device is electrified by the power supply, the actuating rod actuates the actuating plate to move the sliding block from the alignment position to the misalignment position. The locking block is moved from the disengagement position to the engagement position, so that the engaging groove of the locking block engages with the engaging block of the actuating member. The actuating member, the shank, and the handle are not rotatable, and the outer operational device is in a locked state.

When the outer operational device is in a second mode, the insertion section is engaged in the second engagement groove of the sliding block. When the driving device is not electrified by the power supply, the sliding block is in the misalignment position, and the locking block is in the engagement position. The engaging groove of the locking block engages with the engaging block of the actuating member. The actuating member, the shank, and the handle are not rotatable, and the outer operational device is in the locked state.

When the outer operational device is in the second mode and when the driving device is electrified by the power supply, the actuating rod actuates the actuating plate to move the sliding block from the misalignment position to the alignment position. The locking block is moved from the engagement position to the disengagement position, the handle is rotatable from the first position to the second position, so that the outer operational device is in the unlocked state. The handle is rotatable to rotate the actuating member. The driving member is rotated through the link, moving the latch from the latching position to the unlatching position.

In the most preferred form, the sliding block includes two first sides spaced along the first axis and two second sides spaced along the third axis. One of the two first sides faces the first track and includes the depression. One of the two second sides abuts an inner face of the second track. The depression includes an inclined pressing face extending from a bottom end of the depression to the first side including the depression. The inclined pressing face pushes the follower portion of the locking block when the sliding block moves from the alignment position to the misalignment position, moving the locking block from the disengagement position to the engagement position. The other second side of the sliding block includes first, second, and third teeth spaced along the second axis. A first spacing between the first tooth and the depression along the second axis is larger than a second spacing between the second tooth and the depression along the second axis. The second spacing is larger than a third spacing between the third tooth and the depression along the second axis. The first engagement groove is defined between the first and second teeth. The second engagement groove is defined between the second and third teeth. The protrusion includes a first section having first and second faces spaced along the first axis. The protrusion further includes a second section extending from the second face along the first axis. The second section includes two third faces spaced along the second axis. The second section further includes a fourth face spaced from the second face along the first axis. The first track extends from the first face towards but spaced from the fourth face. The second track extends from one of the third faces through the other third face and is in communication with the first track. The protrusion further includes a fifth face spaced from the inner face of the sidewall. The sidewall includes a guiding peg in the first track and extending along the third axis. The locking block includes a guiding recess formed in a bottom wall of the engaging groove. The guiding recess slideably receives the guiding peg, providing stable movement for the locking block.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
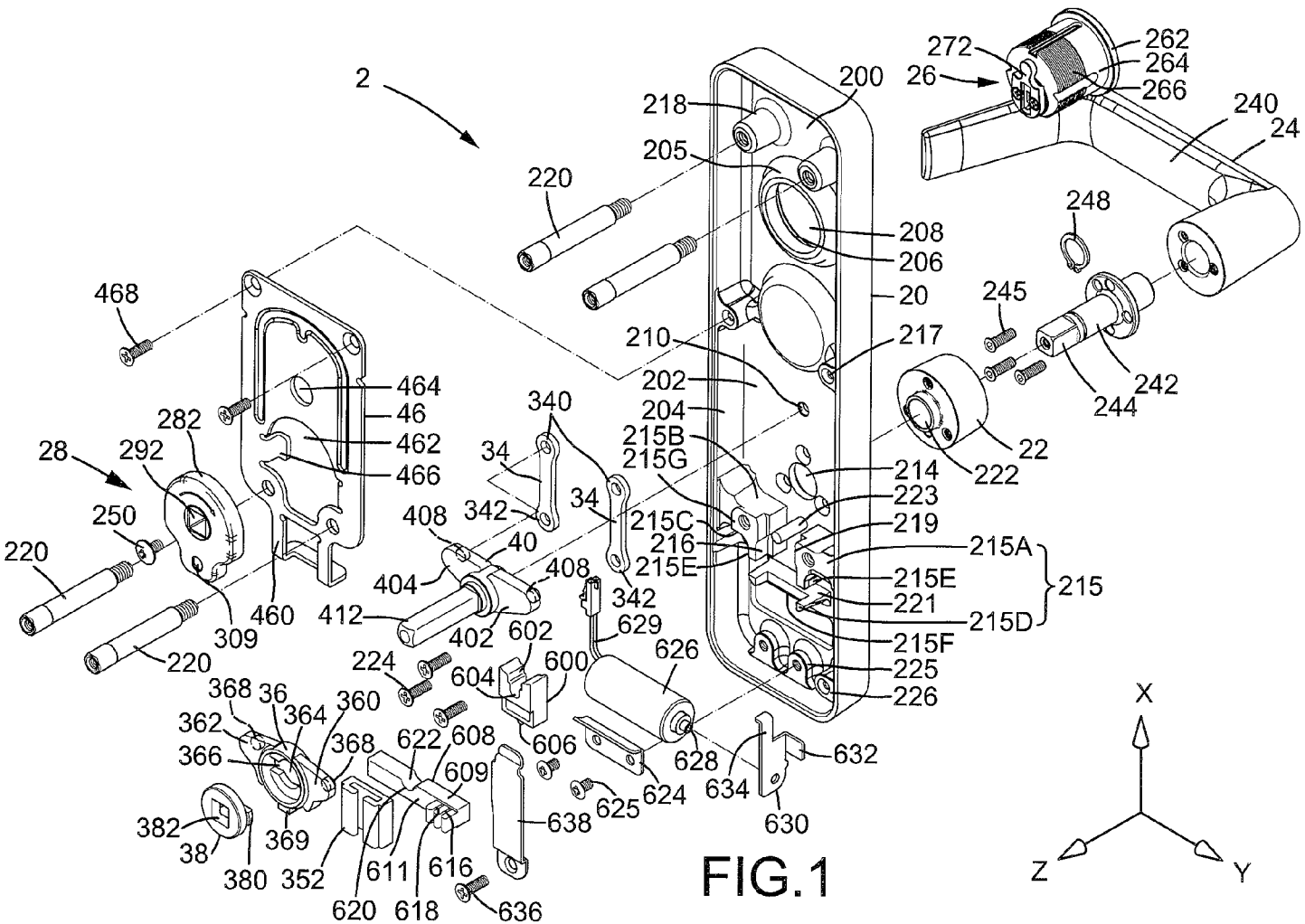
FIG. 1 shows an exploded, perspective view of an outer operational device for a panic exit door lock according to the preferred teachings of the present invention.
Figure 2:
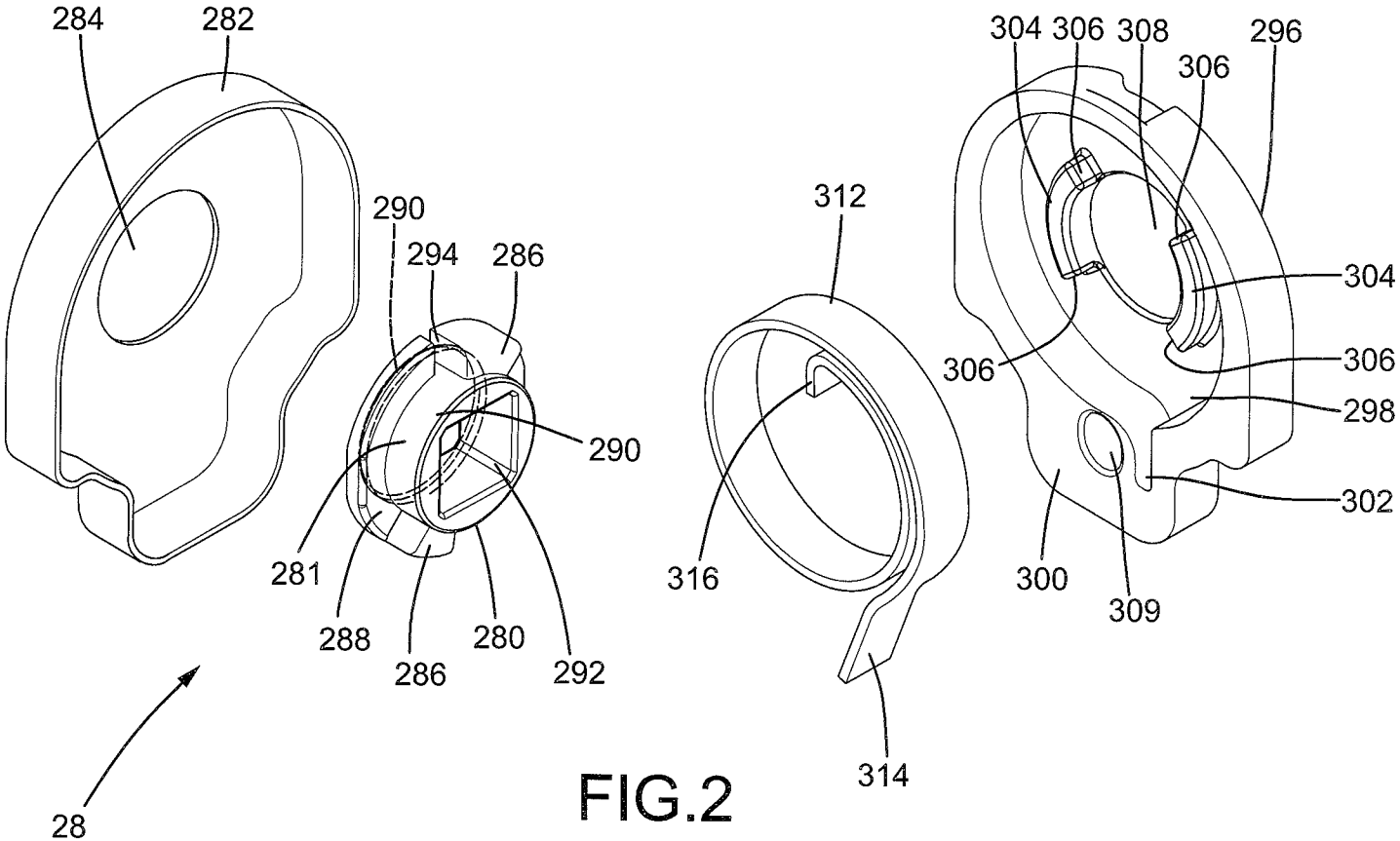
FIG. 2 shows an exploded, perspective view of a returning device of the outer operational device of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "fifth", "lower", "upper", "inner", "outer", "side", "end", "portion", "section", "axial", "lateral", "horizontal", "vertical", "annular", "spacing", "clockwise", "counterclockwise", "length", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

An outer operational device according to the preferred teachings of the present invention is shown in the drawings and generally designated 2. According to the preferred form shown, outer operational device 2 includes a cover 20 having a sidewall 202 and an annular wall 204 extending perpendicularly along a periphery of sidewall 202, defining a space 200 between annular wall 204 and sidewall 202. A protrusion 215 extends from an inner face of sidewall 202. In the most preferred form shown, protrusion 215 has substantially T-shaped cross sections and includes a first section 215A having first and second faces 215B and 215C spaced along a first axis X. Protrusion 215 further includes a second section 215D extending downward from second face 215C along first axis X. Second section 215D includes two third faces 215E spaced along a second axis Y perpendicular to first axis X. Each third face 215E is connected to second face 215C and is spaced from annular wall 204. Second section 215D further includes a fourth face 215F spaced from second face 215C along first axis X. Protrusion 215 further includes a fifth face 215G extending between first, second, third, and fourth faces 215B, 215C, 215E, and 215F. Fifth face 215G is spaced from annular wall 204 along second axis Y and along a third axis Z perpendicular to first and second axes X and Y. A first track 219 extends from first face 215B towards but spaced from fourth face 215F. A second track 221 extends from one of third faces 215E through the other third face 215E of second section 215D along second axis Y and intersects first track 219. A groove 216 is formed in fifth face 215G, is spaced from the inner face of sidewall 202 and is in communication with first and second tracks 219 and 221. A guiding peg 223 is formed on the inner face of sidewall 202 and is located in first track 219 and adjacent to first face 215B. Sidewall 202 includes a receiving portion 205 in an upper portion thereof. Receiving portion 205 extends along third axis Z into space 200 and forms a compartment 206 that has an opening 208 in communication with space 200. Cover 20 further includes an engaging hole 214 extending through sidewall 202 along third axis Z. A fixing hole 210 is formed in an inner face of sidewall 202 and is located below opening 208. Two pegs 218 are formed on the inner face of sidewall 202 and are located above opening 208. Annular wall 204 includes two supports 217 on two inner, vertical faces thereof. Each support 217 has a height from sidewall 202 which is the same as that of protrusion 215 and is located between one of pegs 218 and protrusion 215. Two first fixing portions 225 and a second fixing portion 226 are formed on the inner face of sidewall 202 and are located below protrusion 215.

According to the preferred form shown, outer operational device 2 further includes a cylinder 26 including a cylindrical body 264 having a flange 262 on an end face thereof. A front end of an outer periphery of body 264 includes a threaded portion 266 spaced from flange 262 along third axis Z. A lock core 270 is rotatably received in body 264. A key hole is formed in an end face of lock core 270. An actuator 272 is provided on the other end face of lock core 270. When a key is inserted into the key hole and rotated, lock core 270 and actuator 272 are both rotated. Cylinder 26 is received in compartment 206 of cover 20 with flange 262 abutting a bottom wall of compartment 206. Body 264 is extended through opening 208 of cover 20.

According to the preferred form shown, outer operational device 2 further includes a substantially cylindrical sleeve 22 mounted to an outer face of sidewall 202. Sleeve 22 includes a central pivot hole 222 aligned with engaging hole 214 of cover 20. Fasteners 224 are extended through sidewall 202 into holes in an end face of sleeve 22 to fix sleeve 22 on cover 20.

Figure 8:
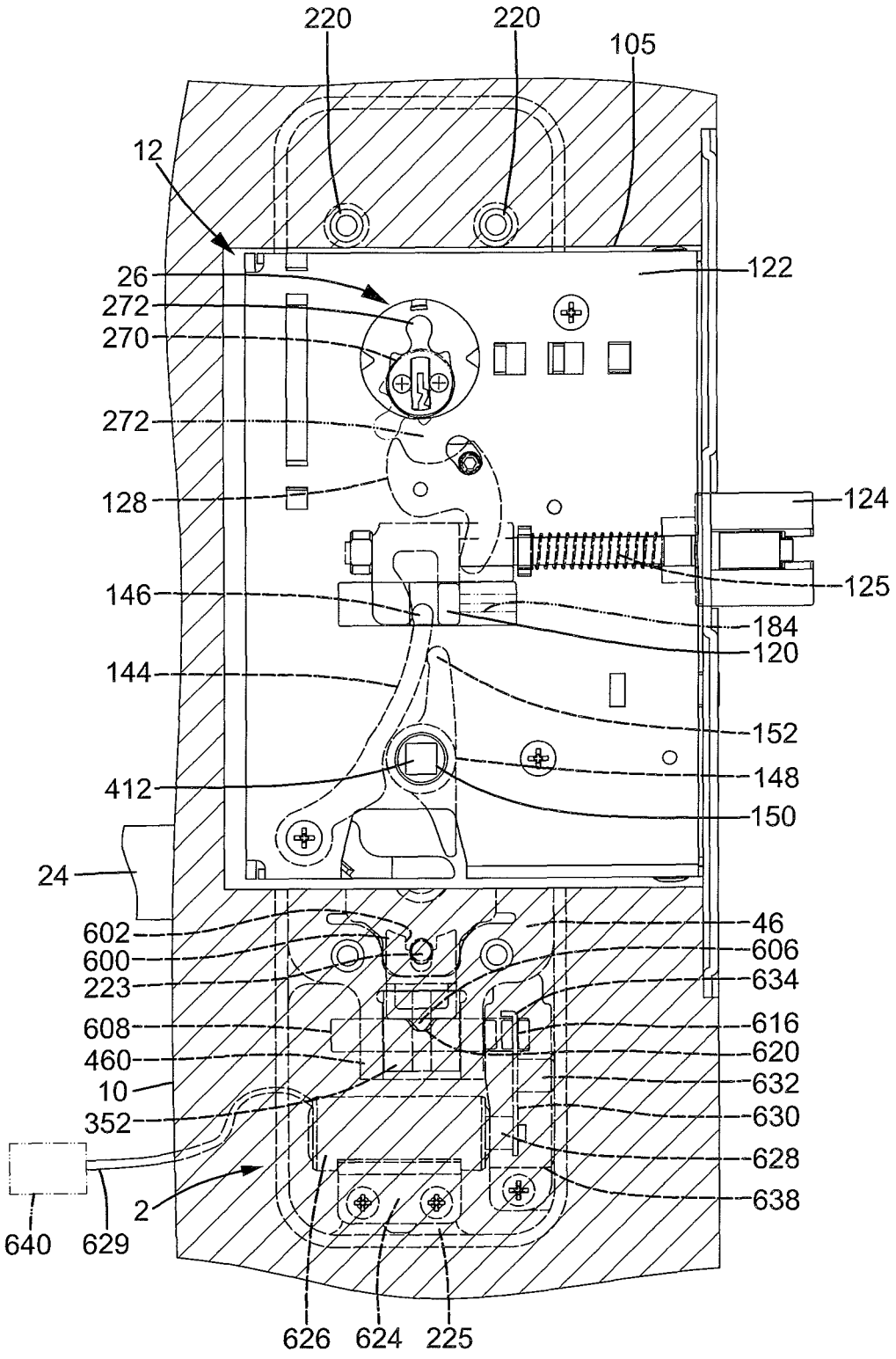
FIG. 8 shows a cross sectional view according to section line 8-8 of FIG. 7.
Figure 9:
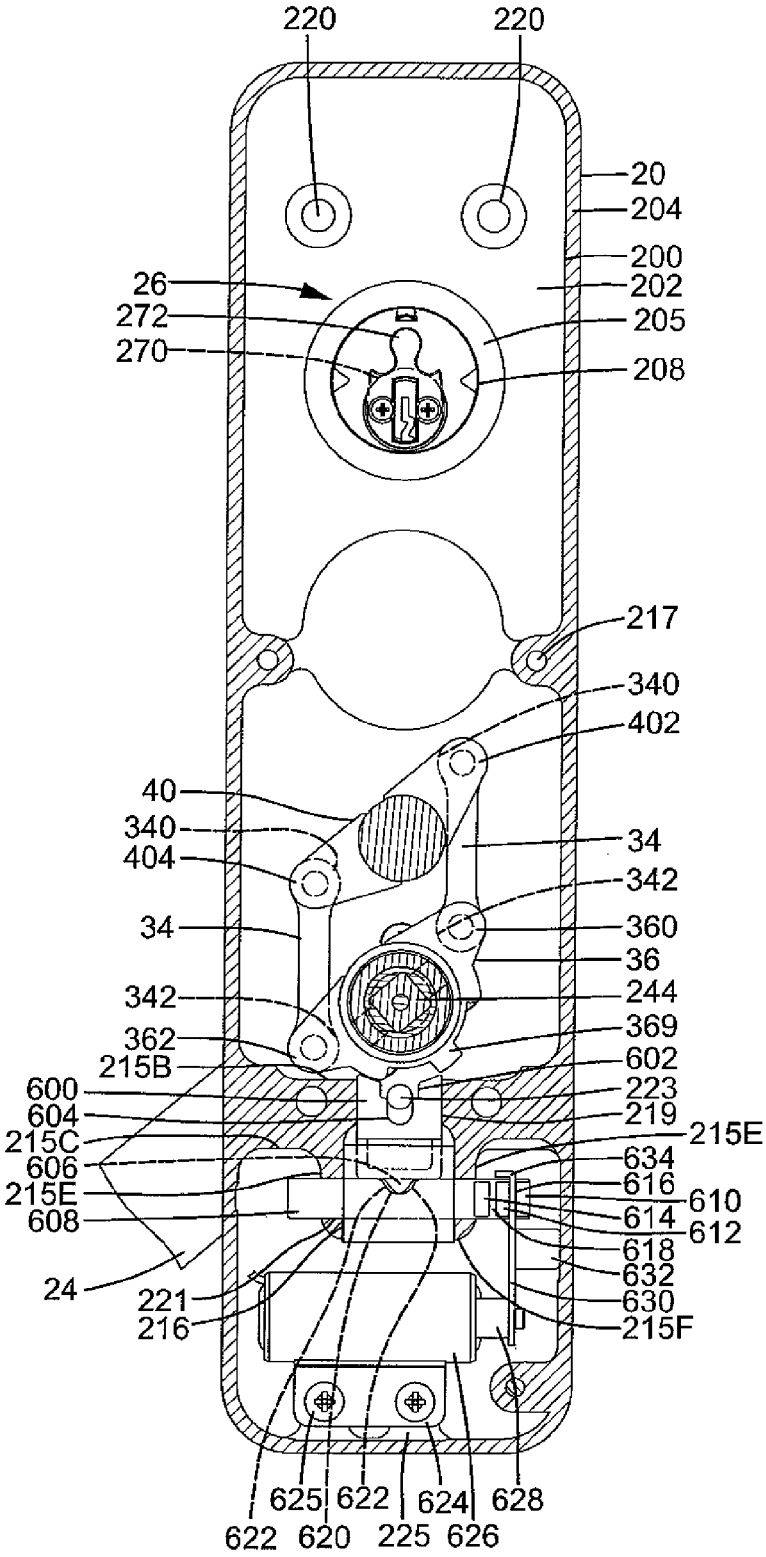
FIG. 9 shows a view similar to FIG. 3 with a handle rotated.
Figure 10:
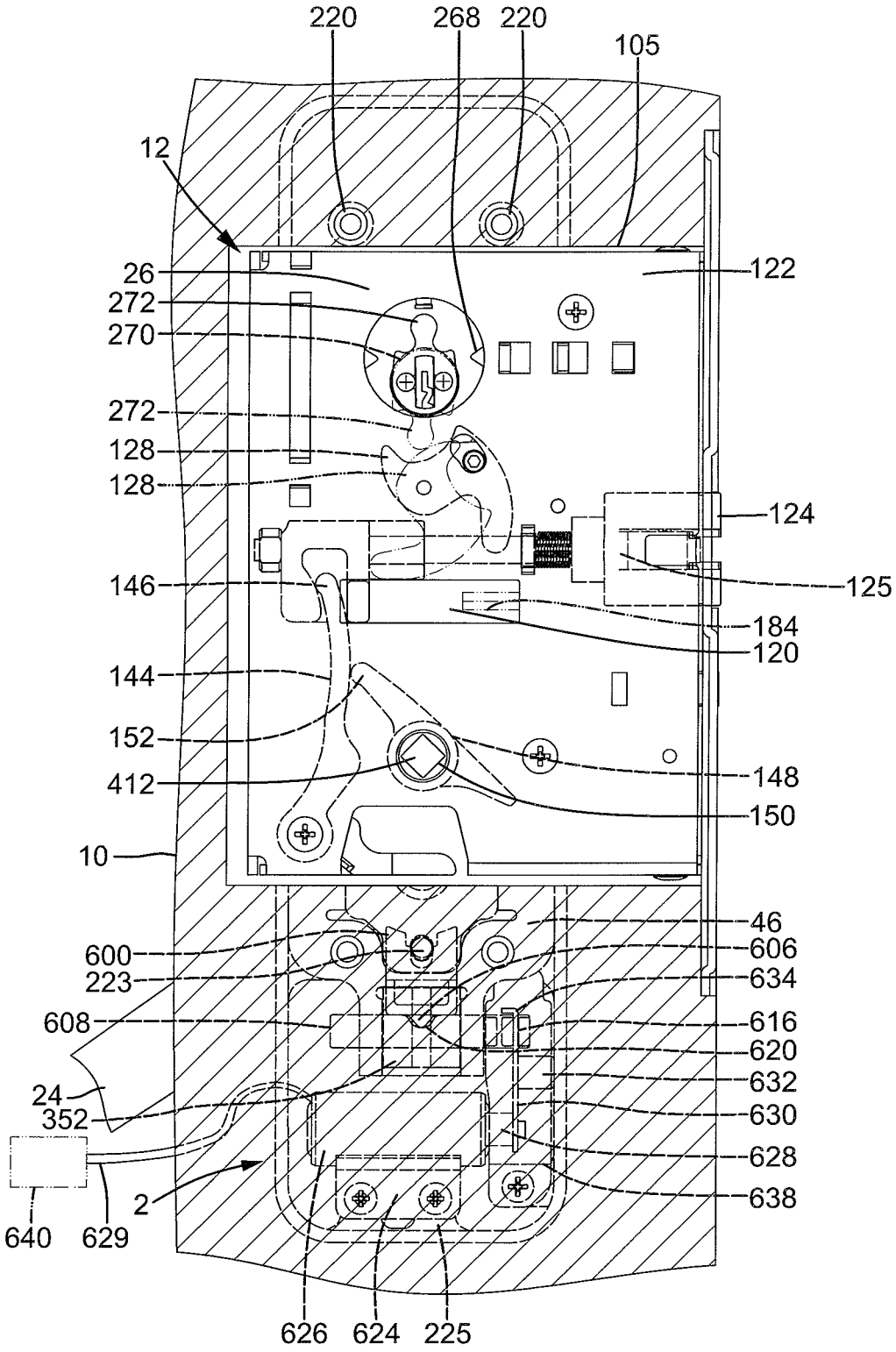
FIG. 10 shows a view similar to FIG. 8 with the handle rotated.

According to the preferred form shown, outer operational device 2 further includes a handle 24 having a stem 240 adapted to be gripped by a user and a shank 242 fixed to stem 240 by screws 245. Shank 242 includes an engaging portion 244 extending along third axis Z and having non-circular cross sections. Shank 242 is extended through pivot hole 222 of sleeve 22 into space 200 of cover 20 and pivotable about third axis Z between a first position (FIGS. 3 and 8) and a second position (FIGS. 9 and 10). A retainer ring 248 is mounted around shank 242 to prevent axial movement of handle 24 along the third axis Z, avoiding disengagement of handle 24 and shank 242 from sleeve 22.

According to the preferred form shown, outer operational device 2 further includes an actuating member 36 received in space 200. Actuating member 36 includes first and second ends 360 and 362 spaced along second axis Y and spaced from each other by about 180° in a circumferential direction about third axis Z. An axle 368 extends from a side of each of first and second ends 360 and 362 along third axis Z. An engaging block 369 extends outward from an outer periphery of actuating member 36 along first axis X and is located intermediate the first and second ends 360 and 362 in the circumferential direction about third axis Z. Engaging block 369 is spaced from each of first and second ends 360 and 362 by about 90° in the circumferential direction about third axis Z. Actuating member 36 further includes a connecting hole 364 extending through an intermediate portion between first and second ends 360 and 362 and extending along third axis Z. Two diametrically opposed grooves 366 are formed in an inner periphery of connecting hole 364 and spaced from the outer periphery of actuating member 36. Shank 242 of handle 24 is pivotably received in connecting hole 364. Axles 368 face the inner face of sidewall 202 of cover 20.

According to the preferred form shown, outer operational device 2 further includes a follower 38 in the most preferred form shown as a ring. Follower 38 includes a non-circular hole 382 corresponding to non-circular engaging portion 244 of handle 24 and extending along third axis Z. Follower 38 further includes two diametrically opposed teeth 380 spaced in the circumferential direction of third axis Z. Engaging portion 244 of handle 24 is received in non-circular hole 382 of follower 38 with teeth 380 engaged in grooves 366. Thus, handle 24 and follower 38 rotate jointly due to non-circular hole 382 and non-circular engaging portion 244. Furthermore, since teeth 380 of follower 38 are engaged in grooves 366 of actuating member 36, rotation of handle 24 between first and second positions also causes rotation of actuating member 36.

According to the preferred form shown, outer operational device 2 further includes a driving member 40 received in space 200. Driving member 40 includes a pivotal portion 410 having opposed first and second wings 402 and 404 spaced in the circumferential direction about third axis Z. Each of first and second wings 402 and 404 includes a peg 408 extending along third axis Z and facing cover 20. A driving rod 412 extends from a side of pivotal portion 410 along third axis Z beyond space 200 and is pivotably received in fixing hole 210 of cover 20, so that driving member 40 is rotatable about third axis Z.

According to the preferred form shown, outer operational device 2 further includes two links 34 each having upper and lower ends 340 and 342. Upper end 340 of first link 34 is pivotably coupled with peg 408 of first wing 402. Upper end 340 of second link 34 is pivotably coupled with peg 408 of second wing 404. Lower end 342 of first link 34 is pivotably coupled with axle 368 of actuating member 36. Lower end 342 of second link 34 is pivotably coupled with axle 368 of actuating member 36.

According to the preferred form shown, outer operational device 2 further includes a returning device 28 having a body 296 with a non-circular outer periphery. Body 296 includes a lobe 300 extending from a lower end thereof along first axis X and having rectangular cross sections. Lobe 300 includes a positioning hole 309. Lobe 300 is received in groove 216 of cover 20 to prevent rotation of body 296. Body 296 further includes a compartment 298 formed in a side thereof and extending along third axis Z. Compartment 298 forms an engaging groove 302 in lobe 300. A bottom wall defining compartment 298 includes a pivot hole 308. Two diametrically opposed limiting blocks 304 are formed on the side of body 296 along a periphery of pivot hole 308 and spaced from each other in the circumferential direction of third axis Z. Each limiting block 304 includes two ends 306. Furthermore, each limiting block 304 has a height to the side of body 296 which is smaller or equal to a depth of compartment 298 along third axis Z. A housing 282 slightly larger than body 296 is mounted to the side of body 296 to cover compartment 298. Housing 282 includes an axial hole 284 extending along third axis Z and aligned with pivot hole 308.

According to the preferred form shown, returning device 28 further includes a substantially cylindrical rotatable member 280 having a flange 288 on an intermediate portion of an outer periphery thereof. Two pivotal portions 290 are formed on opposite sides of flange 288 and are spaced from each other along third axis Z. Also formed on the outer periphery of rotatable member 280 are first and second blocks 286 adjacent two ends of flange 288 and extending along third axis Z. A slit 294 is formed between flange 288 and first block 286 and extends in a radial direction perpendicular to third axis Z. Rotatable member 280 further includes a non-circular hole 292 through which engaging portion 244 of handle 24 extends. Pivotal portions 290 are respectively and pivotably received in pivot hole 308 of body 296 and axial hole 284 of housing 282 with blocks 286 located between limiting blocks 304. The spacing between limiting blocks 304 and blocks 286 limits rotation of rotatable member 280.

According to the preferred form shown, returning device 28 further includes an elastic element 312 in the form of a spiral spring having a spiral section, a first, outer tang 314 outside of the spiral section, and a second, inner tang 316 inside of the spiral section. The spiral section of elastic element 312 is mounted around limiting blocks 304 and located in compartment 298 with first, outer tang 314 abutting against a wall of engaging groove 302 and with second, inner tang 316 received in slit 294 of rotatable member 280 and abutting against a side of first block 286 adjacent slit 294. Thus, first tang 314 is fixed to body 296, and second tang 316 is fixed in slit 294. Rotatable member 280 is biased by elastic element 312 so that each of first and second blocks 286 press against one of ends 306 of one of limiting blocks 304. In this state, stem 240 of handle 24 is in a horizontal state with rotatable member 280 in its initial position. When rotatable member 280 is rotated, first block 286 adjacent slit 294 presses against second tang 316 of elastic element 312 to store the restoring force.

Returning device 28 is mounted around shank 242. Namely, engaging portion 244 of shank 242 is extended through non-circular hole 292 of rotatable member 280. Lobe 300 is received in groove 216 of cover 20. Guiding peg 223 is extended through positioning hole 309 of body 296 such that returning device 28 can not rotate relative to cover 20 about third axis Z. Thus, when handle 24 is rotated, shank 242 rotates jointly with rotatable member 280. Due to the non-circular coupling between engaging portion 244 and rotatable member 280, elastic element 312 is twisted by rotatable member 280 when handle 24 is rotated. Returning device 28 is fixed by a fastener 250 that extends into a screw hole in an end face of engaging portion 244 and that includes a head abutting against rotatable member 280, so that returning device 28 can not move along engaging portion 244. Thus, returning device 28 is retained to shank 242. When handle 24 is released, elastic element 312 returns rotatable member 280 to its initial position and returns handle 24 to its initial, horizontal position.

Figure 11:
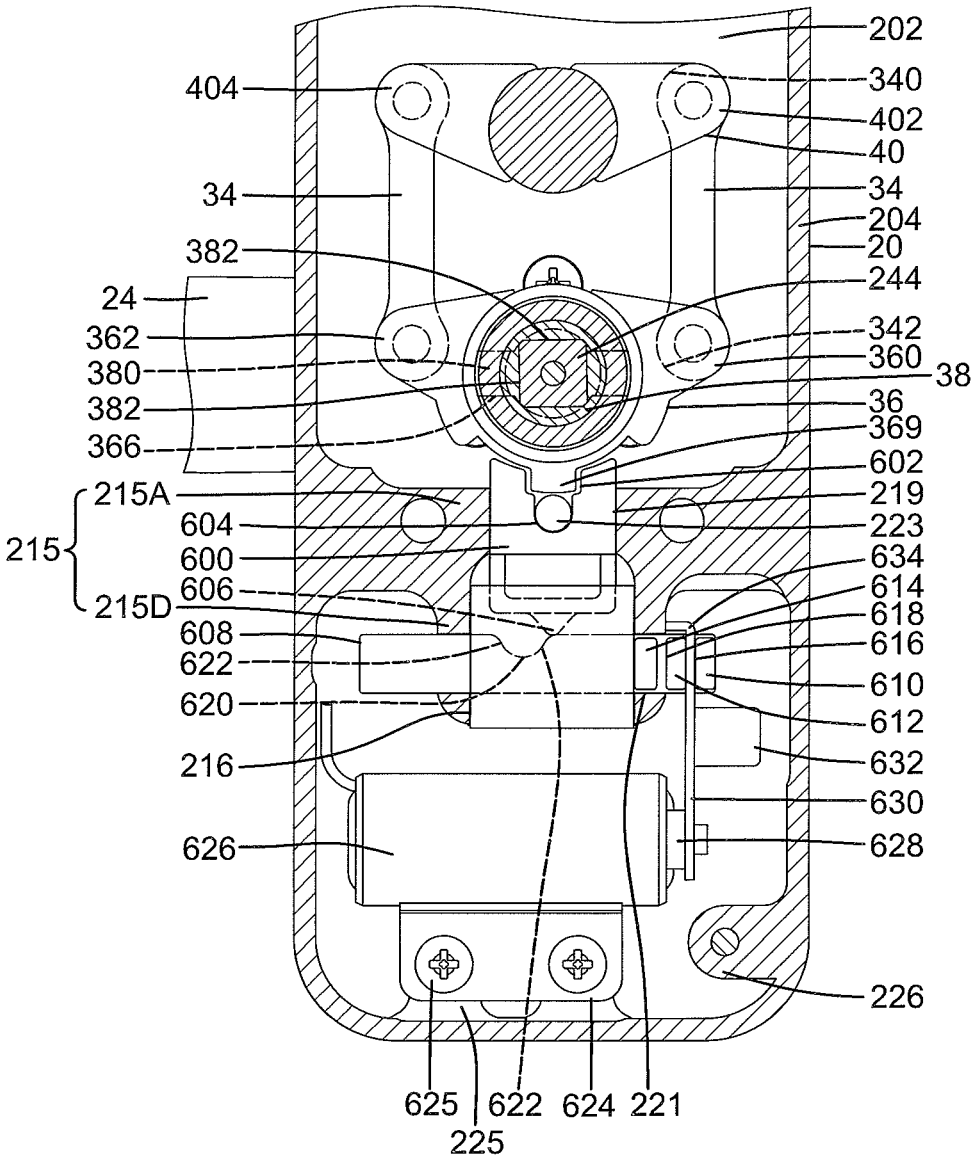
FIG. 11 shows a partial, cross sectional view of the outer operational device of FIG. 1 with the outer operational device in a first mode and in a locking state after electrification.

According to the preferred form shown, outer operational device 2 further includes a locking block 600 slideably received in first track 219 along first axis X. Locking block 600 includes an engaging groove 602 extending from a top side towards but spaced from a bottom side of locking block 600 along first axis X. A guiding recess 604 is formed in a bottom wall of engaging groove 602 and is spaced from the bottom side of locking block 600 along first axis X. A follower portion 606 is formed on a side of locking block 600. In the most preferred form shown, follower portion 606 is in the form of a protrusion extending downward from the bottom side of locking block 600 along first axis X. Engaging groove 602 and guiding recess 604 face engaging block 369 of actuating member 36. Guiding peg 223 of cover 20 is received in guiding recess 604 of locking block 600 such that locking block 600 can slide in first track 219 along first axis X between a disengagement position (FIG. 3) and an engagement position (FIG. 11). When locking block 600 is in the engagement position, an end of guiding recess 604 extends beyond first face 215B of protrusion 215, and an end wall of guiding recess 604 abuts against guiding peg 223 to provide a positioning effect.

According to the preferred form shown, outer operational device 2 further includes a sliding block 608 slideably received in second track 221 of cover 20 along second axis Y. Sliding block 608 includes two first sides 609 spaced along first axis X and two second sides 611 spaced along third axis Z. A depression 620 is formed on one of first sides 609 and extends along first axis X. Depression 620 includes two pressing faces 622 extending from a bottom end of depression 620 to first side 609. Each pressing face 622 is in the form of a sloped face. First, second, and third teeth 610, 612, and 614 are formed on one of second sides 611, extend along third axis Z, and are spaced from each other along second axis Y. A spacing between first tooth 610 and depression 620 along second axis Y is larger than a spacing between second tooth 612 and depression 620 along second axis Y, which, in turn, is larger than a spacing between third tooth 614 and depression 620 along second axis Y. Thus, a first engagement groove 616 is defined between first and second teeth 610 and 612, and a second engagement groove 618 is defined between second and third teeth 612 and 614. Sliding block 608 has a length in second axis Y which is larger than a spacing between third faces 215E of protrusion 215 along second axis Y.

Depression 620 of sliding block 608 faces follower portion 606 of locking block 600. First and second engagement grooves 616 and 618 face away from the inner face of sidewall 202 of cover 20. Sliding block 608 is slideable in second track 221 along second axis Y between an alignment position (FIGS. 3 and 8) and a misalignment position (FIG. 11). When sliding block 608 is in the alignment position, depression 620 is aligned with follower portion 606 of locking block 600. First, second, and third teeth 610, 612, and 614 extend beyond one of third faces 215E of protrusion 215. When sliding block 608 is in the misalignment position, depression 620 is not aligned with follower portion 606 of locking block 600.

According to the preferred form shown, outer operational device 2 further includes a pressing block 352 received in groove 216 of cover 20. A side of pressing block 352 abuts a side of locking block 600 and a side of sliding block 608 to prevent locking block 600 and sliding block 608 from disengaging from first and second tracks 219 and 221.

According to the preferred form shown, outer operational device 2 further includes an inner lid 46 having an opening 462 through which engaging portion 244 of handle 24 extends. Two bends 466 are formed on an inner periphery of opening 462 and are spaced from each other along second axis Y. Inner lid 46 further includes a substantially L-shaped positioning portion 460. Inner lid 46 further includes a through-hole 464 above opening 462. Inner lid 46 abuts protrusion 215 and supports 217, and fasteners 468 are extended through inner lid 46 into screw holes in supports 217. Two mounting posts 220 are extended through inner lid 46 into screw holes in protrusion 215. Thus, inner lid 46 is fixed in space 200 of cover 20 and is fixed to supports 217 and fifth face 215G of protrusion 215. An end of driving rod 412 is pivotably extended through through-hole 464 and is extended beyond inner lid 46 to support stable rotation of driving member 40. Returning device 28 is received in opening 462 of inner lid 46 and abuts against bends 466. Positioning portion 460 of inner lid 46 abuts an outer side of pressing block 352, preventing pressing block 352 from disengaging from groove 216. Another two mounting posts 220 are extended into screw holes in pegs 218.

Figure 13:
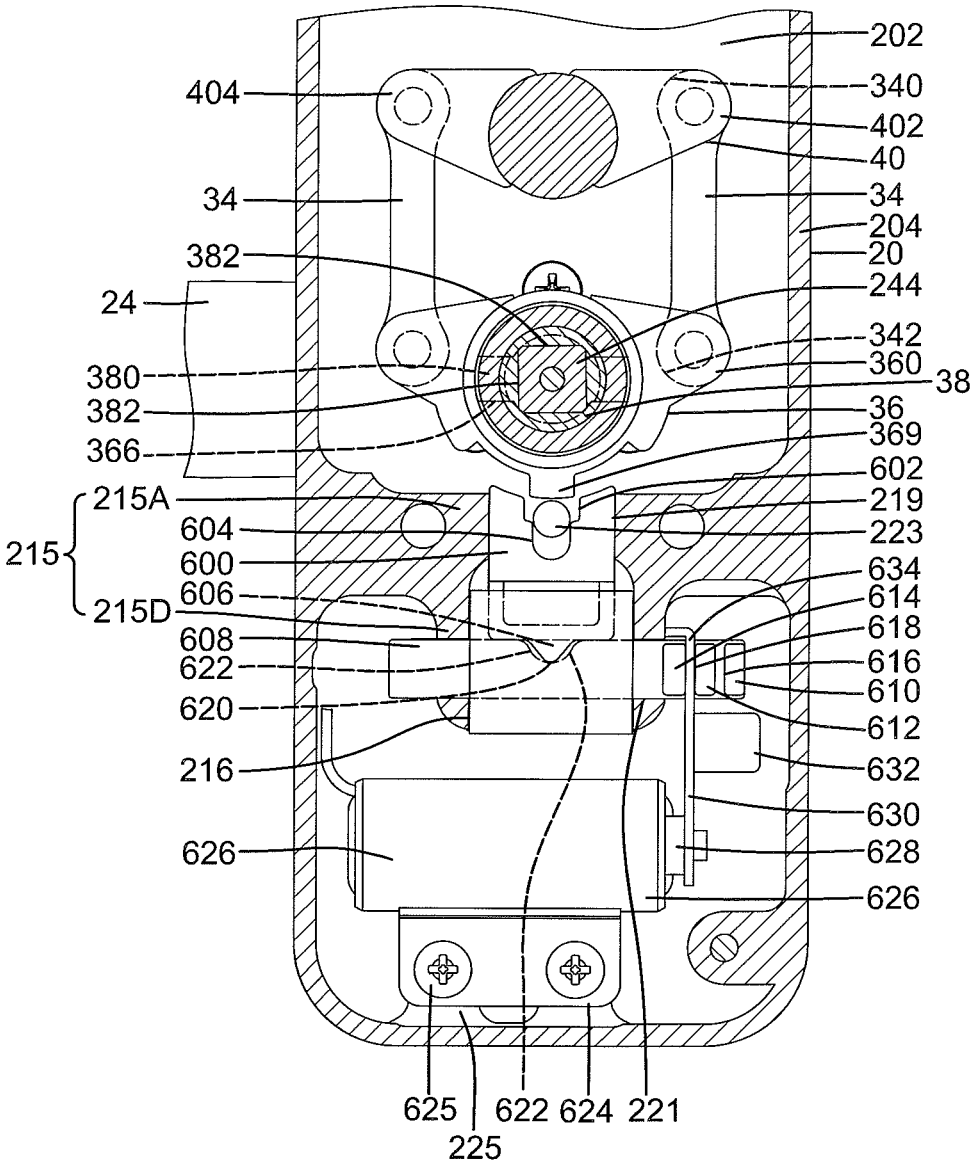
FIG. 13 shows a partial, cross sectional view of the outer operational device of FIG. 12 with the outer operational device in the second mode and in an unlocking state after electrification.

According to the preferred form shown, outer operational device 2 further includes a retaining member 624 and a driving device 626. The driving device 626 includes an actuating rod 628 and a cable 629 electrically connected to a power supply 640. When power supply 640 supplies electricity to driving device 626, driving device 626 generates a magnetic force to retract actuating rod 628 (FIGS. 11 and 13). When power supply 640 does not supply electricity to driving device 626, driving device 626 does not generate a magnetic force, and actuating rod 628 is biased by a spring in driving device 626 to its original position. Driving device 626 is mounted in space 200 of cover 20 and is located below and spaced from fourth face 215F of protrusion 215 along first axis X. Two screws 625 are extended through holes in retaining member 624 and into screw holes in first fixing portions 225, fixing retaining member 624 in space 200 of cover 20. Retaining member 624 presses against and, thus, retains driving device 626 in space 200 of cover 20.

According to the preferred form shown, outer operational device 2 further includes an actuating plate 630 mounted to a distal end of actuating rod 628. Actuating plate 630 includes an insertion section 634 extending from a periphery thereof along first axis X. Actuating plate 630 further includes a supporting plate 632 extending from a lateral side thereof along second axis Y. Supporting plate 632 abuts the inner face of sidewall 202 of cover 20. Actuating plate 630 can move jointly with actuating rod 628 of driving device 626.

According to the preferred form shown, outer operational device 2 further includes a restraining plate 638 fixed by a screw 636 to second fixing portion 226 of cover 20. Restraining plate 638 abuts a periphery of actuating plate 630 to prevent actuating plate 630 from pivoting about second axis Y relative to actuating rod 628.

Outer operational device 2 can be assembled to be in a first mode (FIGS. 1-11) in which outer operational device 2 is in a locking state when driving device 626 is electrified or a second mode (FIGS. 12 and 13) in which outer operational device 2 is in an unlocking state when driving device 626 is electrified.

Figure 3:
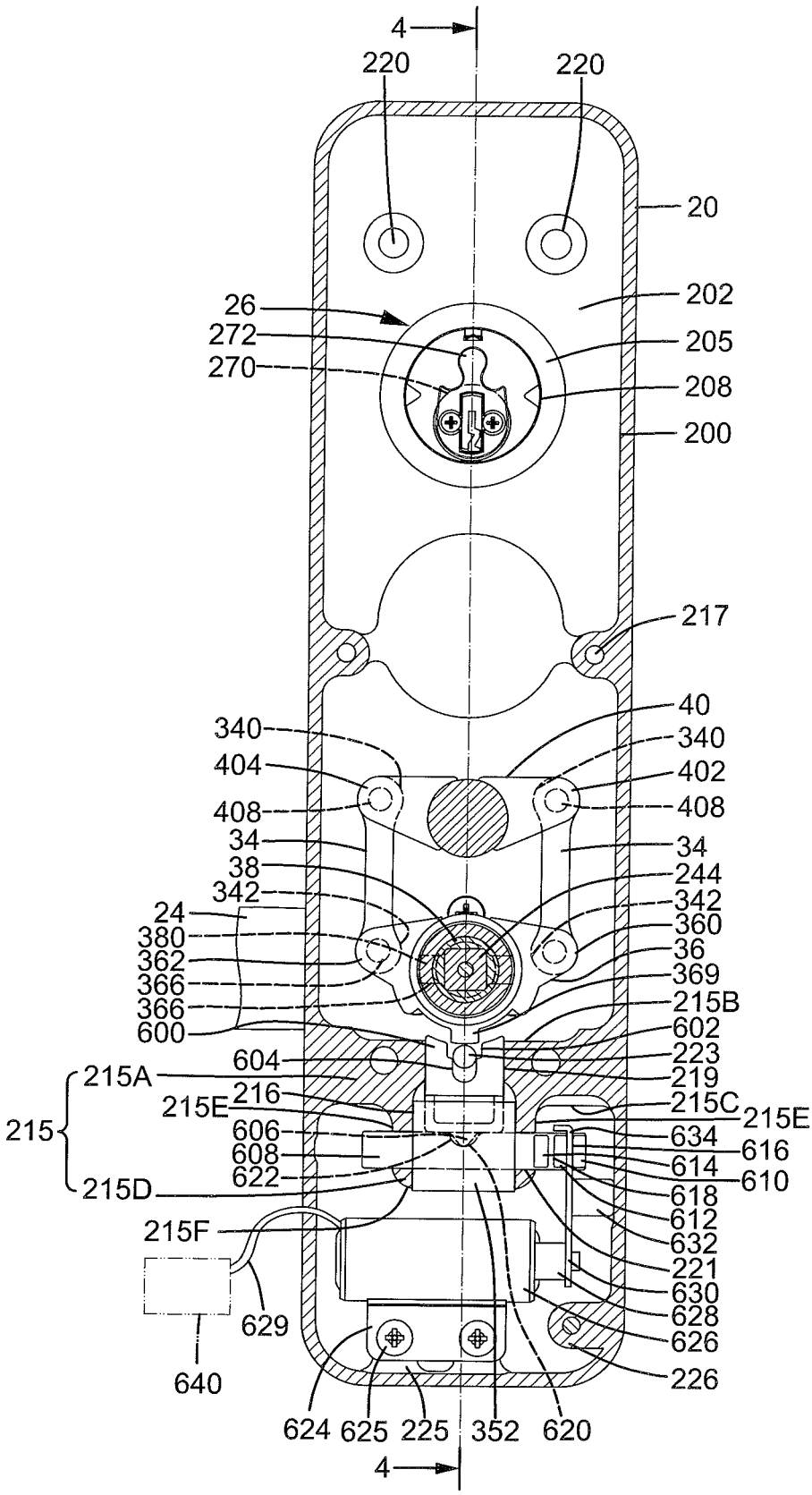
FIG. 3 shows a cross sectional view of the outer operational device of FIG. 1 with the outer operational device in a first mode.
Figure 4:
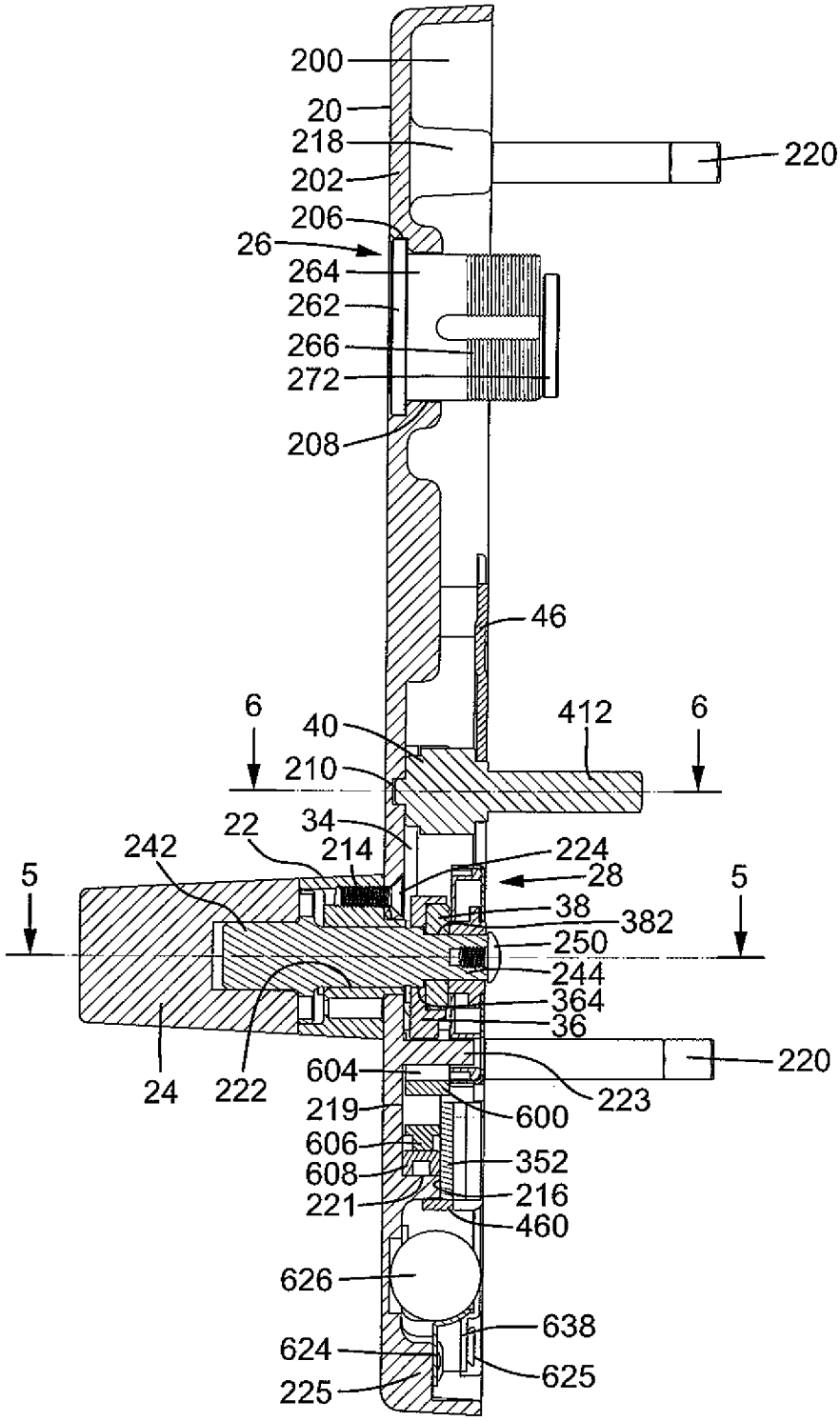
FIG. 4 shows a cross sectional view according to section line 4-4 of FIG. 3.
Figure 5:
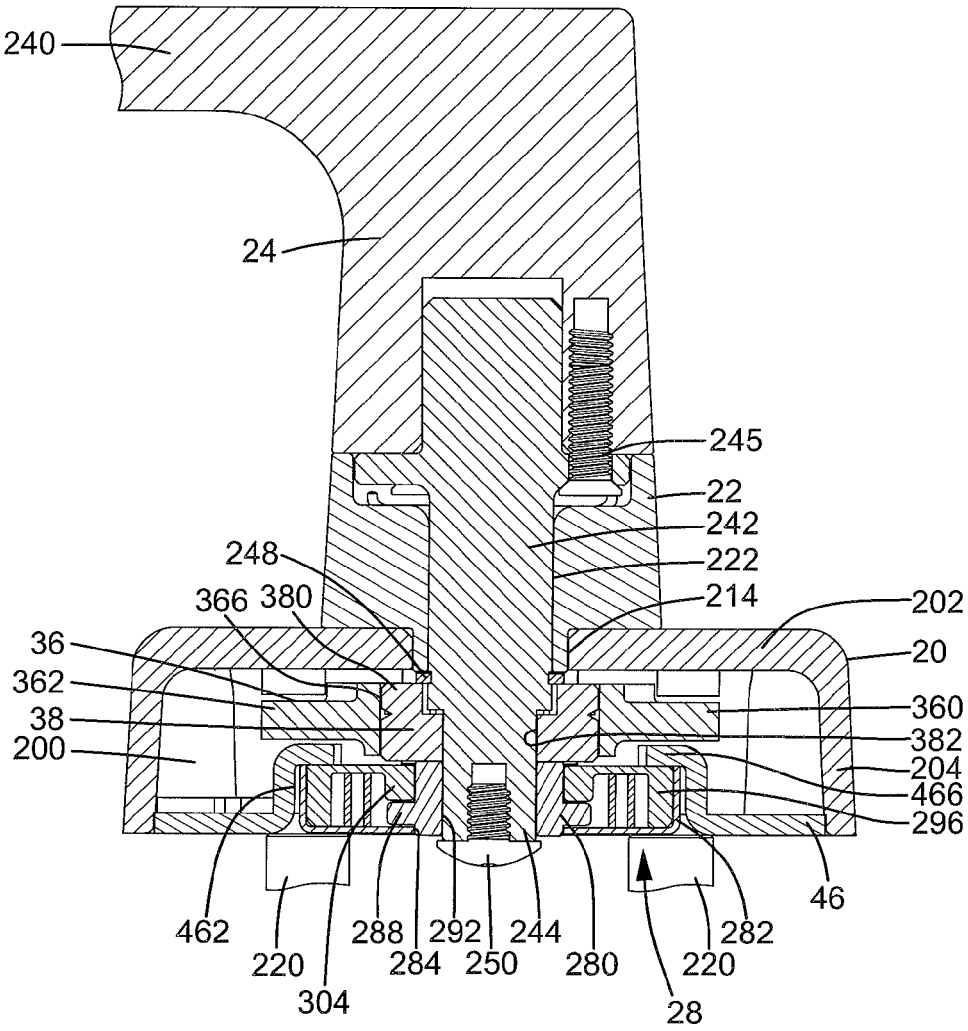
FIG. 5 shows a cross sectional view according to section line 5-5 of FIG. 4.
Figure 6:
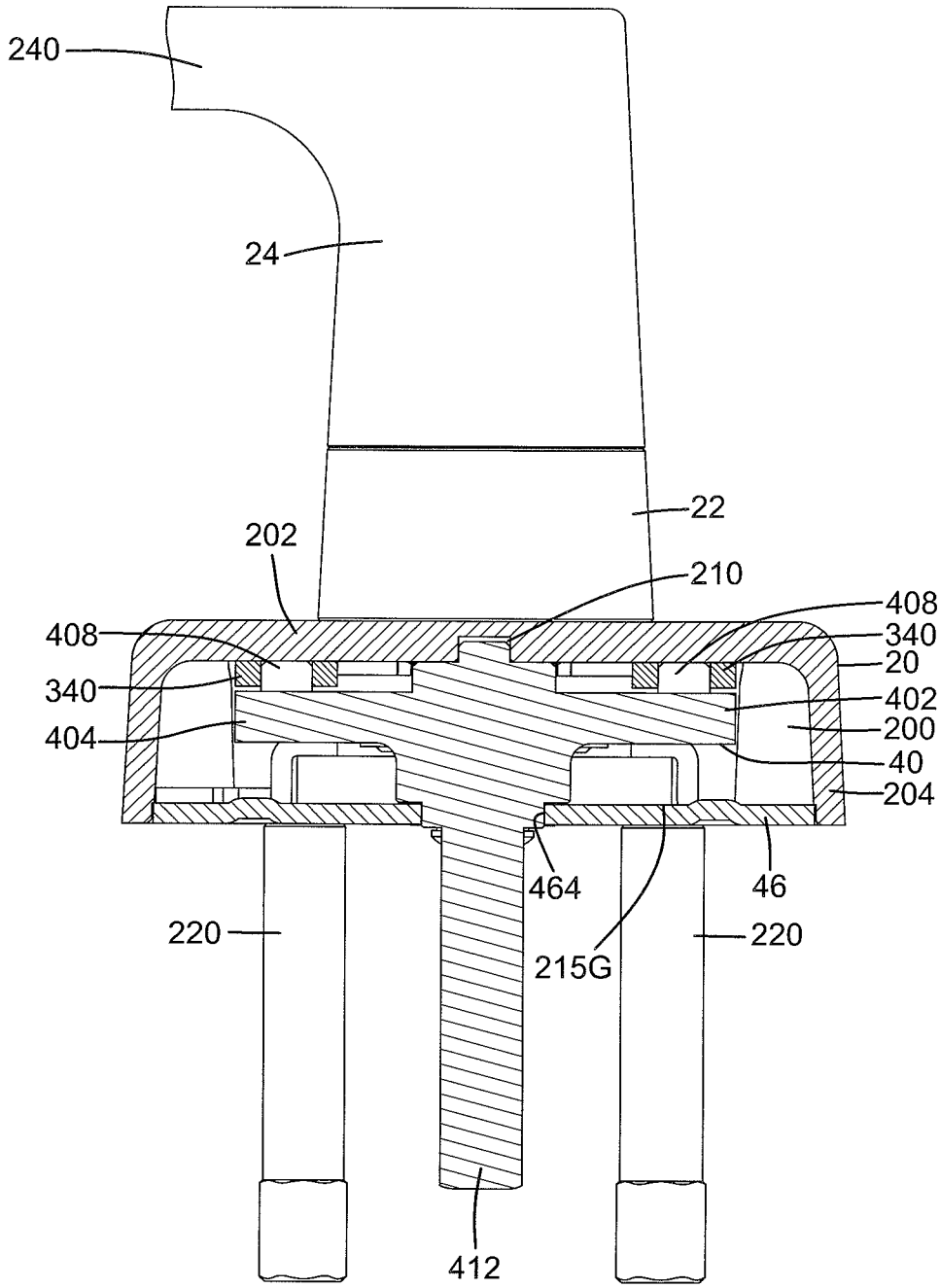
FIG. 6 shows a cross sectional view according to section line 6-6 of FIG. 4.
Figure 7:
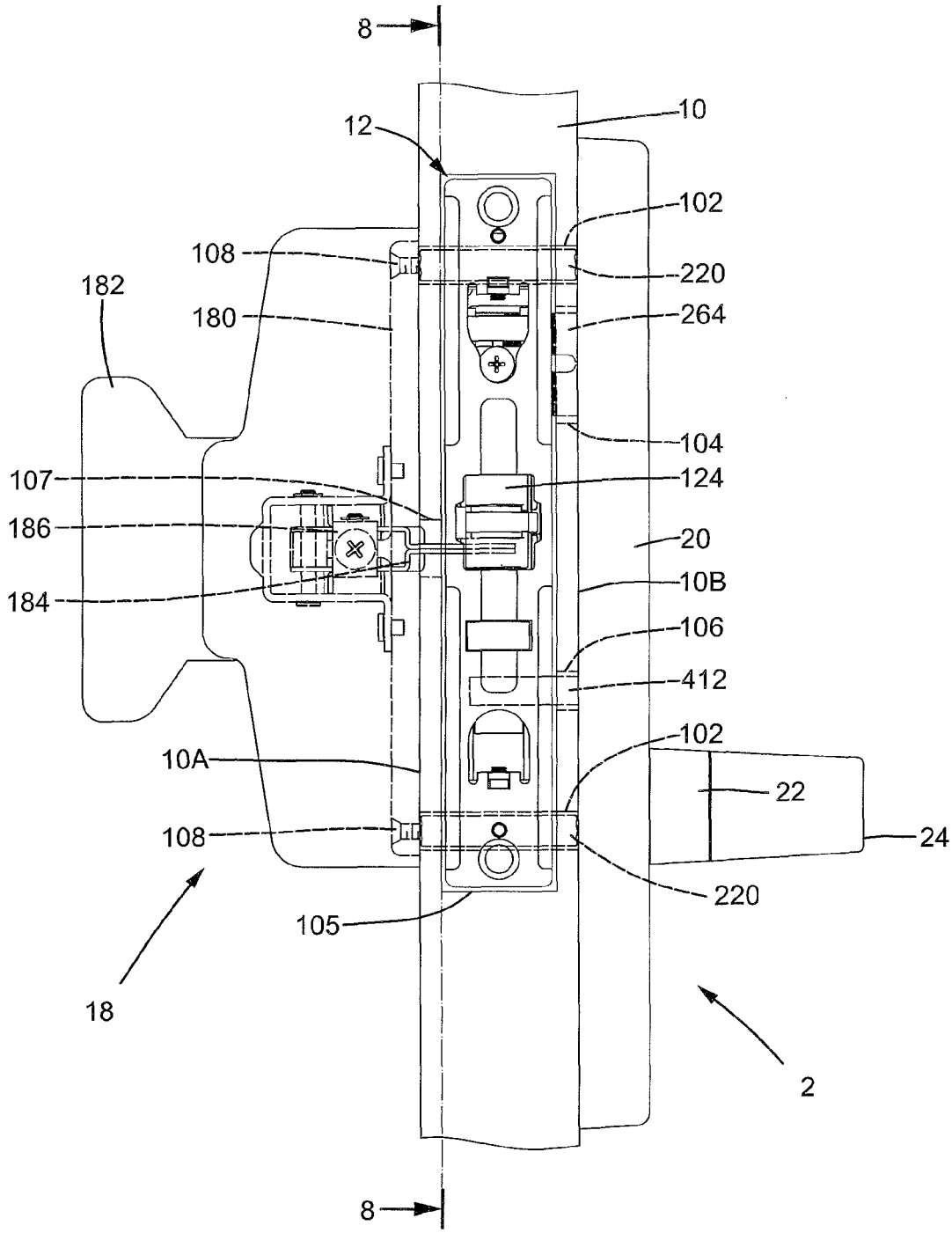
FIG. 7 shows a partial, side elevational view of a panic exit door and the outer operational device according to the present invention.

Specifically, in the first mode (FIGS. 1-11), insertion section 634 of actuating plate 630 is engaged in first engagement groove 616 between first and second teeth 610 and 612 of sliding block 608. In a case that power supply 640 does not supply electricity to driving device 626, sliding block 608 is in the alignment position, and locking block 600 is in the disengagement position (FIGS. 3 and 8). In another case that power supply 640 supplies electricity to driving device 626, actuating rod 628 is retracted, and insertion section 634 of actuating plate 630 pushes against a side of second tooth 612, moving sliding block 608 from the alignment position (FIGS. 3 and 8) to the misalignment position (FIG. 11). Locking block 600 is moved upward along first axis X from the disengagement position to the engagement position by pressing faces 622 of depression 620.

Figure 12:
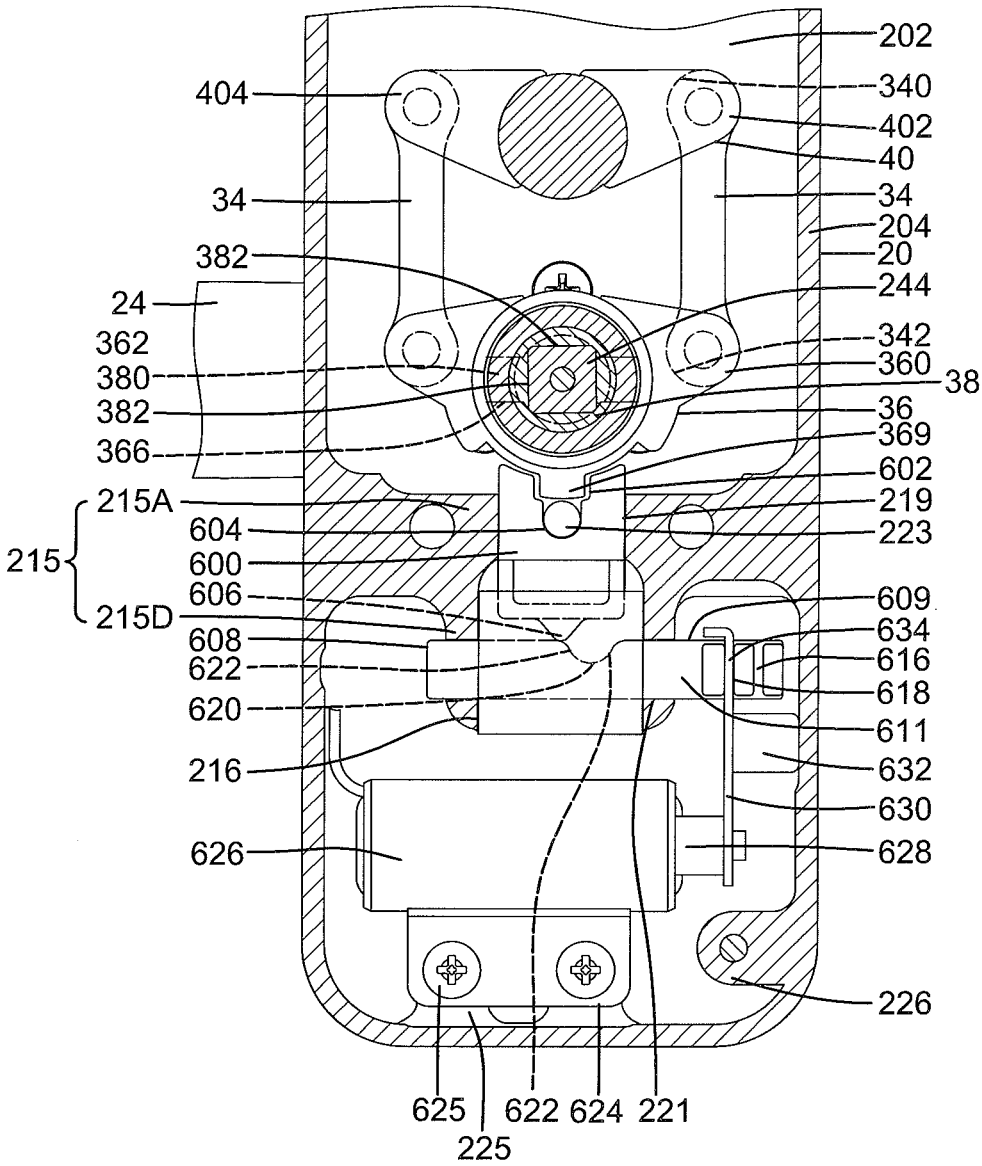
FIG. 12 shows a partial, cross sectional view of the outer operational device of FIG. 1 with the outer operational device in a second mode.

On the other hand, in the second mode (FIGS. 12 and 13), insertion section 634 of actuating plate 630 is engaged in second engagement groove 618 between second and third teeth 612 and 614 of sliding block 608. In a case that power supply 640 does not supply electricity to driving device 626, sliding block 608 is in the alignment position, and locking block 600 is in the engagement position (FIG. 12). In another case that power supply 640 supplies electricity to driving device 626, actuating rod 628 is retracted, and insertion section 634 of actuating plate 630 pushes against the other side of second tooth 612, moving sliding block 608 from the misalignment position (FIG. 12) to the alignment position (FIG. 13). Locking block 600 moves downward along first axis X from the disengagement position to the engagement position under the action of gravity.

According to the preferred form shown, outer operational device 2 is adapted to be mounted to a side of a door 10 such as a panic exit door. Door 10 includes an inner side 10A and an outer side 10B. Furthermore, door 10 includes a mounting hole 105 in an edge extending between inner side 10A and outer side 10B. Door 10 further includes a plurality of first holes 102 extending from inner side 10A through outer side 10B. Door 10 further includes a second hole 104 and a third hole 106 in outer side 10B and a fourth hole 107 in inner side 10A. Each of holes 102, 104, 106, and 107 is in communication with mounting hole 105. A lock 12 is mounted in mounting hole 105. An inner operational device 18 is mounted to inner side 10A of door 10, and outer operational device 2 according to the preferred teachings of the present invention is mounted to outer side 10B of door 10.

According to the preferred form shown, lock 12 includes a case 122 mounted in mounting hole 105 of door 10. A retractor 120 is slideably received in case 122. A spring 125 is mounted between retractor 120 and a latch 124. Latch 124 can move along second axis Y between an extended, latching position outside of case 122 and a retracted, unlatching position inside of case 122 responsive to sliding movement of retractor 120. Lock 12 further includes a transmission block 128 pivotably received in case 122 and operatively connected to retractor 120 (FIG. 8). When transmission block 128 is pivoted, retractor 120 can be moved from the latching position to the unlatching position (see phantom lines in FIG. 10).

According to the preferred form shown, an unlocking member 148 is pivotably mounted in case 122 below latch 124. Unlocking member 148 is substantially T-shaped and includes an arm 152. A hole 150 is formed in unlocking member 148, extends along third axis Z, and has cross sections which are the same as driving rod 412. Driving rod 412 is extended through third hole 106 into hole 150 of unlocking member 148, so that rotation of driving rod 412 also causes rotation of unlocking member 148.

According to the preferred form shown, a push rod 144 is pivotably mounted in case 122 and is adjacent to unlocking member 148. Push rod 144 is arcuate and includes an end 146 abutting retractor 120. The other end of push rod 144 is pivotably connected to case 122. Arm 152 of unlocking member 148 abuts a side of push rod 144. In most preferred form shown, push rod 144 can only be pushed by first arm 152 to pivot when unlocking member 148 rotates in the counterclockwise direction in FIG. 2. Namely, push rod 144 is not moved if unlocking member 148 rotates in the clockwise direction.

According to the preferred form shown, inner operational device 18 includes a base 180, a driving rod 184 pivotably mounted to base 180, and a linking rod 186 slideably received in base 180. An operative member 182 in the most preferred form shown as a press bar is pivotably mounted outside of base 180 and operably connected to linking rod 186. An end of driving rod 184 is extended through fourth hole 107 of door 10 into case 122 of lock 12 and abuts a side of retractor 120. When operative member 182 is actuated, linking rod 186 is moved to draw driving rod 184, which in turn, moves retractor 120. Thus, latch 124 is moved from the extended, latching position to the retracted, unlatching position.

In assembly, outer operational device 2 is mounted to outer side 10B of door 10 with four mounting posts 220 extending through first holes 102 of door 10. Driving rod 412 is extended through third hole 106 of door 10 into case 122, engaging driving rod 412 in hole 150 of unlocking member 148. Body 264 is extended through opening 208 of cover 20 and second hole 104 of door 10 into mounting hole 105 of door 10 with threaded portion 266 received in case 122 of lock 12 and with actuator 272 operatively connected to transmission block 128 (FIG. 8). When actuator 272 of cylinder 26 is rotated, transmission block 128 pivots to retract latch 124 to the unlatching position (see phantom lines in FIG. 10). Fasteners 108 are extended through base 180 into screw holes in mounting posts 220, fixing inner and outer operational devices 18 and 2 to inner and outer sides 10A and 10B of door 10.

Now that the basic construction of outer operational device 2 of the preferred teachings of the present invention has been explained, the operation and some of the advantages of outer operational device 2 can be set forth and appreciated. In particular, for the sake of explanation, it will be assumed that outer operational device 2 is in the first mode. Handle 24 is in the first position. Sliding block 608 is in the alignment position, and locking block 600 is in the disengagement position. Engaging groove 602 of locking block 600 is disengaged from engaging block 369 of actuating member 36. In this state, handle 24 can be rotated from the first position to the second position about third axis Z. Follower 38 and rotatable member 280 of returning device 28 rotate jointly with engaging portion 244, so that block 286 moves second tang 316 of elastic element 312 and so that elastic element 312 is twisted to store potential energy for returning purposes. Actuating member 36 is rotated by teeth 380 of follower 38. Links 34 are driven by axles 368 of actuating member 36 to move in a reverse direction. One of links 34 moves upward to push first wing 402, and the other link 34 moves downward to push second wing 404, causing rotation of driving member 40. At the same time, driving rod 412 rotates jointly with driving member 40, so that driving rod 412 actuates unlocking member 148 of lock 12 to rotate in the same direction. Arm 152 drives push rod 144 to rotate, and end 146 of push rod 144 pushes retractor 120 to move in the unlatching direction (leftward direction in FIG. 8) to compress spring 125. When rotatable member 280 rotates to an extreme position in which one of blocks 286 abuts against one of ends 306 of one of limiting blocks 304, latch 124 is moved from the extended, latching position to the retracted, unlatching position (FIG. 10).

When handle 24 is released, second tang 316 of elastic element 312 returns rotatable member 280 from the extreme position back to the initial position, which in turn, rotates handle 24 to its initial position via engaging portion 244. First and second ends 360 and 362 of actuating member 36 are at the same level. Furthermore, latch 124 is moved by spring 125 to the extended, latching position. At the same time, links 34 move first wing 402 and second wing 404 in opposite directions until first and second wings 402 and 404 are at the same level.

With reference to FIG. 11, when outer operational device 2 is in the first mode and when power supply 640 supplies driving device 626 with electricity, sliding block 608 moves from the alignment position to the misalignment position. Locking block 600 is moved by sliding block 608 from the disengagement position to the engagement position, so that engaging groove 602 of locking block 600 is engaged with engaging block 369 of actuating member 36. Thus, actuating member 36 is locked by locking block 369 and is not rotatable, preventing rotation of handle 24 and shank 242. As a result, latch 124 can not be moved to the retracted position.

On the other hand, when outer operational device 2 is in the second mode and when driving device 626 is not electrified by power supply 640 (FIG. 12), sliding block 608 is in the misalignment position, and locking block 600 is in the engagement position. Engaging groove 602 of locking block 600 is engaged with engaging block 369 of actuating member 36. Thus, actuating member 36 is locked by locking block 369 and is not rotatable, preventing rotation of handle 24 and shank 242. As a result, latch 124 can not be moved to the retracted position.

When outer operational device 2 is in the second mode and when driving device 626 is electrified by power supply 640, sliding block 608 is moved from the misalignment position to the alignment position by actuating plate 630, and locking block 600 falls from the engagement position to the disengagement position under the action of gravity (FIG. 13). Thus, engaging groove 602 of locking block 600 is disengaged from engaging block 369 of actuating member 36. In this state, handle 24 can be rotated from the first position to the second position about third axis Z. Follower 38 and rotatable member 280 of returning device 28 rotate jointly with engaging portion 244, so that block 286 moves second tang 316 of elastic element 312 and so that elastic element 312 is twisted to store potential energy for returning purposes. Actuating member 36 is rotated by teeth 380 of follower 38. Links 34 are driven by axles 368 of actuating member 36 to move in a reverse direction. One of links 34 moves upward to push first wing 402, and the other link 34 moves downward to push second wing 404, causing rotation of driving member 40. At the same time, driving rod 412 rotates jointly with driving member 40, so that driving rod 412 actuates unlocking member 148 of lock 12 to rotate in the same direction. Arm 152 drives push rod 144 to rotate, and end 146 of push rod 144 pushes retractor 120 to move in the unlatching direction to compress spring 125. When rotatable member 280 rotates to an extreme position in which one of blocks 286 abuts against one of ends 306 of one of limiting blocks 304, latch 124 is moved from the extended, latching position to the retracted, unlatching position.

By engaging actuating plate 630 with first engagement groove 616 or second engagement groove 618 of sliding block 608, outer operational device 2 according to the present invention can be set to be in the first mode or the second mode through electrification of driving device 626 by power supply 640, providing a locking or unlocking function. Thus, no replacement of components is required while changing the operational mode of a panic exit door lock, providing convenient use.

Now that the basic teachings of the present invention have been explained, many extensions and variations will be obvious to one having ordinary skill in the art. For example, actuating member 36 can include only one axle 368, and driving member 40 can include only one wing 402 or 404 corresponding to axle 368. In this case, only one link 34 is required. Latch 124 can still be unlatched through rotation of handle 24. Furthermore, driving device 626 can be retained in space 200 by other provisions instead of retaining member 624. As an example, positioning portion 460 of inner lid 46 can extend to a position pressing against driving device 626. Thus, when inner lid 46 is fixed to cover 20, inner lid 46 can press against and retain pressing block 352 and driving device 626 in space 200 of cover 20. Furthermore, actuating plate 630 does not have to include restraining plate 638. Likewise, positioning portion 460 of inner lid 46 can extend to a position pressing against an end face of actuating plate 630 to retain actuating plate 630 in space 200. Further, outer operational device 2 does not have to include returning device 28. Since driving rod 412 of driving member 40 is operatively connected to lock 12, handle 24 can be moved together with driving member 40 and returned from the second position to the first position under the action of spring 125 that returns latch 124 from the unlatching position to the latching position.

Furthermore, protrusion 215 does not have to include T-shaped cross sections. As an example, protrusion 215 can be a parallelepiped. First track 219 extends from an upper face along first axis X towards but spaced from a lower face of the parallelepiped. Second track 221 and groove 216 can be directly formed in fifth face 215G. Furthermore, first and second engagement grooves 616 and 618 of sliding block 608 can be formed by other provisions instead of first, second, and third teeth 610, 612, and 614. As an example, first and second engagement grooves 616 and 618 can be directly formed in one of second sides 611. Further, follower portion 606 of locking block 600 can be in the form of a roller on a lower end thereof. The roller is rotatably mounted to locking block 600 and is engaged in depression 620 of sliding block 608. Sliding block 608 is moved while the roller moves along one or both of the pressing faces 622 of depression 620.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. An outer operational device for a panic exit door lock, comprising:

a cover adapted to be mounted to an outer side of a door, with the cover including a sidewall and an annular wall together defining a space, with a protrusion formed on an inner face of the sidewall, with the protrusion including a first track extending along a first axis and a second track extending along a second axis perpendicular to the first axis and in communication with the first axis;

a handle mounted to an outer side of the cover, with the handle rotatable about a third axis perpendicular to the first and second axes between first and second positions, with a shank fixed to the handle to rotate therewith, with the shank including a non-circular engaging portion extending into the space of the cover;

an actuating member mounted in the space and including at least one end and a non-circular connecting hole engaged with the engaging portion to rotate therewith, with the actuating member further including an engaging block aligned with the first track;

a driving member rotatably received in the space of the cover, with the driving member including at least one wing and a driving rod, with the driving rod extending along the third axis, with the driving rod adapted to be operatively connected to a latch of a lock mounted in the door, so that the latch is moved from a latching position to an unlatching position when the handle is rotated from the first position to the second position;

at least one link including an upper end and a lower end, with the upper end of the at least one link pivotably connected to the at least one wing of the driving member, with the lower end of the at least one link pivotably connected to the at least one end of the actuating member such that the driving member is rotated when the handle is rotated between the first and second positions;

a locking block slideably received in the first track along the first axis between an engagement position and a disengagement position, with the locking block including top and bottom sides spaced along the first axis, with an engaging groove extending from the top side towards but spaced from the bottom side, with the locking block further including a follower portion, with the engaging block of the actuating member engaged in the engaging groove when the locking block is in the engagement position, preventing rotation of the actuating member about the third axis, with the engaging block of the actuating member disengaged from the engaging groove when the locking block is in the disengagement position, allowing rotation of the actuating member about the third axis;

a sliding block slideably received in the second track along the second axis between an alignment position and a misalignment position, with the sliding block including a depression extending along the first axis, with the sliding block further including first and second engagement grooves spaced along the second axis, with the follower portion of the locking block engaged in the depression of the sliding block an with when the locking block is in the disengagement position and the sliding block is in the alignment position, with a face of the depression of the sliding block pushing the follower portion of the locking block to move the locking block to the engagement position when the sliding block is moved from the alignment position to the misalignment position;

a driving device mounted in the space of the cover and spaced from the second track along the first axis, with the driving device including an actuating rod, with the driving device electrically connected to a power supply; and an actuating plate fixed to the actuating rod to move therewith, with the actuating plate including an insertion section, wherein when the outer operational device is in a first mode, the insertion section is engaged in the first engagement groove of the sliding block, when the driving device is not electrified by the power supply, the sliding block is in the alignment position, and the locking block is in the disengagement position, the handle is rotatable from the first position to the second position, so that the outer operational device is in an unlocked state, the handle is rotatable to rotate the actuating member, and the driving member is rotated through the at least one link, moving the latch from the latching position to the unlatching position, wherein when the outer operational device is in the first mode and when the driving device is electrified by the power supply, the actuating rod actuates the actuating plate to move the sliding block from the alignment position to the misalignment position, the locking block is moved from the disengagement position to the engagement position, so that the engaging groove of the locking block engages with the engaging block of the actuating member, the actuating member, the shank, and the handle are not rotatable, and the outer operational device is in a locked state, wherein when the outer operational device is in a second mode, the insertion section is engaged in the second engagement groove of the sliding block, and when the driving device is not electrified by the power supply, the sliding block is in the misalignment position, the locking block is in the engagement position, the engaging groove of the locking block engages with the engaging block of the actuating member, the actuating member, the shank, and the handle are not rotatable, and the outer operational device is in the locked state, and wherein when the outer operational device is in the second mode and when the driving device is electrified by the power supply, the actuating rod actuates the actuating plate to move the sliding block from the misalignment position to the alignment position, the locking block is moved from the engagement position to the disengagement position, and the handle is rotatable from the first position to the second position, so that the outer operational device is in the unlocked state, the handle is rotatable to rotate the actuating member, and the driving member is rotated through the at least one link, moving the latch from the latching position to the unlatching position.

2. The outer operational device as claimed in claim 1, with the sliding block including two first sides spaced along the first axis and two second sides spaced along the third axis, with one of the two first sides facing the first track and including the depression, with one of the two second sides abutting an inner face of the second track, with the depression including at least one inclined pressing face extending from a bottom end of the depression to the first side including the depression, with the at least one inclined pressing face pushing the follower portion of the locking block when the sliding block moves from the alignment position to the misalignment position, moving the locking block from the disengagement position to the engagement position when the outer operational device is in the first mode.

3. The outer operational device as claimed in claim 2, with another of the two second sides of the sliding block including first, second, and third teeth spaced along the second axis, with a first spacing between the first tooth and the depression along the second axis being larger than a second spacing being between the second tooth and the depression along the second axis, with the second spacing larger than a third spacing between the third tooth and the depression along the second axis, with the first engagement groove defined between the first and second teeth, with the second engagement groove defined between the second and third teeth.

4. The outer operational device as claimed in claim 2, with the protrusion including a first section having first and second faces spaced along the first axis, with the protrusion further including a second section extending from the second face along the first axis, with the second section including two third faces spaced along the second axis, with the second section further including a fourth face spaced from the second face along the first axis, with the first track extending from the first face towards but spaced from the fourth face, with the second track extending from one of the two third faces through another of the two third faces and in communication with the first track.

5. The outer operational device as claimed in claim 4, with the protrusion further including a fifth face spaced from the inner face of the sidewall, with a groove formed in the fifth face and intersecting the first and second tracks, with the outer operational device further including a pressing block and an inner lid, with the pressing block received in the groove of the protrusion, with the inner lid fixed to the fifth face of the protrusion, retaining the locking block in the first track and retaining the sliding block in the second track, with the inner lid retaining the pressing block in the groove of the protrusion.

6. The outer operational device as claimed in claim 1, with the sidewall including a guiding peg in the first track and extending along the third axis, with the locking block including a guiding recess formed in a bottom wall of the engaging groove, with the guiding recess slideably receiving the guiding peg, providing stable movement for the locking block.

7. The outer operational device as claimed in claim 1, with the actuating plate including a supporting plate extending along the second axis, with the supporting plate slideably abutting the inner face of the sidewall of the cover, providing stable movement for the actuating plate.

8. The outer operational device as claimed in claim 7, with the cover further including at least one first fixing portion and a second fixing portion formed on the inner face of the sidewall, with the outer operational device further comprising: a retaining member and a restraining plate, with the retaining member fixed to the at least one first fixing portion and pressing against and retaining the driving device in the space of the cover, with the restraining plate fixed to the second fixing portion and pressing against the actuating plate to retain the actuating plate in the space of the cover.

* * * * *